United States Patent [19]

Ohno

[11] Patent Number: 5,074,353

[45] Date of Patent: Dec. 24, 1991

[54] METHOD FOR HORIZONTAL CONTINUOUS CASTING OF METAL STRIP AND APPARATUS THEREFOR

[75] Inventor: Atsumi Ohno, Tokyo, Japan

[73] Assignee: Kabushiki Kaisha O. C. C., Tokyo, Japan

[21] Appl. No.: 617,205

[22] Filed: Nov. 23, 1990

[30] Foreign Application Priority Data

Feb. 19, 1990 [JP] Japan ..... 2-37904

[51] Int. Cl.[5] ..... B22D 11/124

[52] U.S. Cl. ..... 164/122.1; 164/440; 164/490; 164/444; 164/486

[58] Field of Search ..... 164/122.1, 122.2, 440, 164/490, 444, 485, 486

[56] References Cited

U.S. PATENT DOCUMENTS 4,605,056 8/1986 Ohno ..... 164/490

4,789,022 12/1988 Ohno ..... 164/122.1

*Primary Examiner*—Kuang Y. Lin

*Attorney, Agent, or Firm*—Kanesaka and Takeuchi

[57] ABSTRACT

Disclosed is a method for horizontal continuous casting of a metal strip cast product having a unidirectionally solidified structure elongated in the direction of casting, comprising the steps of supplying a molten casting metal into a hot mold having a shape substantially like a gutter opened at its upper side and being heated to a temperature not lower than the solidification temperature of the casting metal, and drawing out a metal molding formed in the hot mold by using a dummy member while cooling the drawn-out metal molding, wherein the cooling is performed on the metal molding within the hot mold at a position in front a solidification starting end portion of the metal molding but in the rear of an outlet of the hot mold with respect to the direction of movement of the metal molding, so that the metal molding is drawn out, after cooled, from the hot mold.

20 Claims, 3 Drawing Sheets

METHOD FOR HORIZONTAL CONTINUOUS CASTING OF METAL STRIP AND APPARATUS THEREFOR

BACKGROUND OF THE INVENTION

1. Field of the Invention

The present invention relates to a method for continuous casting of cast products and an apparatus therefor, and particularly relates to a method for horizontal continuous casting of metal strip cast products having a completely unidirectional solidified structure which is wholly elongated in the direction of casting by use of a substantially horizontally disposed gutter like hot mold and an apparatus therefor.

2. Description of the Related Art

A conventional method for horizontal continuous casting of cast products is a method in which a through hollow cold mold is horizontally disposed, a molten metal is supplied from one end of the mold, the supplied molten metal is solidified in the mold, and a cast product is continuously drawn out from the other end of the mold. This method has been widely used for performing casting to obtain cast products of an iron alloy, an aluminum alloy, a copper alloy, or the like.

However, this method has such disadvantages that the molten metal supplied into the mold forms a solidified shell along the wall surface of the mold, and a not-yet solidified molten metal in the inside enclosed by the soldified shell is completely solidified through secondary cooling at the outside of the mold, so that impurities are concentrated to thereby generate defects such as component segregation and/or bubbles in the finally solidified portion at the center of the cast product.

Further, in such a conventional method, intermittent drawing in which a stably solidified shell of a cast product coming out from the mold is grown and then the cast produce is drawn out has been performed in order to prevent occurrence of surface cracks due to friction between the mold and the surface of the cast product in drawing the cast product and breakout of the molten metal. However, oscillation marks formed in the surface of the cast product through intermittent drawing may cause cracks in plastic working on the cast product. In order to eliminate such surface defects of the cast product generated in casting, it has been necessary to perform surface treatment on the cast product, such as removal of cracks, surface cutting, surface dissolving, or the like, before the cast product is subjected to plastic working.

Further, in the case of casting an alloy such as cast iron or phosphorus bronze which has a wide range of solidification temperature, it has been impossible to draw out the cast product without generation of surface cracks, unless the cast product is intermittently drawn out from the mold after the molten metal has been completely solidified in the mold.

The conventional method for horizontal continuous casting has been a method in which a solidified shell is formed on the inner wall surface of such a cold mold, so that crystals constituting the solidified shell have been apt to grow columnlike in the direction substantially perpendicular to the wall surface of the mold. If a columnar crystal zone is formed in the surface layer of a cast product, cracks may be easily caused, from the crystal grain boundary, by friction between the cast product and the inner wall surface of the mold when the cast product is drawn from the mold. Further, in a cast product in which such a columnar crystal zone is formed in the outer circumference thereof, surface cracks may be easily caused in plastic working. Particularly, in the case of casting a metal or an alloy having poor workability, it has been considered that, even if such a metal or an alloy is cast into a cast product through continuous casting, it is difficult to make the cast product into a plate or a wire through plastic working.

In Japanese Patent Post-Examination Publication No. sho-55-46265 published Nov. 21, 1980, the inventor of this application proposed a novel continuous casting method with objects that such a surface solidified shell as described above is prevented from being formed on the inner wall surface of the mold, that crystals have a completely unidirectional solidified structure grown only in the direction of casting, and that surface defects due to friction between the cast product and the mold are prevented from being generated, thereby obtaining a metal molding having a smooth surface and having a desired cross section. The invention disclosed in the above Japanese Patent Past-Examination Publication No. Sho-55-46265 has been granted as Japanese Patent No. 1049146. This novel continuous casting method is a method in which a hollow mold is heated by a heating element so that the temperature of the inner wall surface at the outlet of the mold is to a value not lower than the solidification temperature of a casting metal, whereby a molten metal supplied from a moltenmetal holding furnace does not form any solidified shell on the inner wall surface of the mold, but a not-solidified molten metal on the surface of a cast product is started to be solidified at the outside of the outlet of the mold to thereby obtain a metal cast product having an unidirectional solidified structure elongated in the direction of casting through continuous casting.

In the case where the novel continuous casting method is applied to the horizontal continuous casting method described above, however, there is a possibility of occurrence of breakout of a molten metal at an outlet end of the mold depending on fine changes in temperature of the inside of the mold, in temperature of cooling water, and in rate of casting because solidification of a cast product is performed in the vicinity of the outlet of the mold. Accordingly, it is very important to always accurately grasp the position and shape of the solidified boundary surface in the mold.

In U.S. Pat. No. 4,605,056 granted on Aug. 12, 1986, therefore, the inventor of this application proposed a method for horizontal continuous casting of metal moldings in which the position of a solidified boundary surface can be accurately grasped by opening an upper portion of a hot mold, and an apparatus for realizing this method. According to this horizontal continuous casting method, a hot mold having a concave section opened in its upper surface is horizontally provided, in place of the hollow hot mold, on a side wall of a molten metal holding furnace just under the surface of the molten metal, a molten metal is caused to flow into the hot mold, and after the top end of a metal molding dummy previously set in the mold comes in contact with the molten metal, the dummy is drawn out of the mold and passed through a cooling means provided outside the mold so that the dummy and the metal molding following the dummy are cooled. If the mold is heated by a heating element provided on the mold so as to keep the temperature of the inner wall surface of the mold to a value not lower than the solidification temperature of the casting metal, the metal molding in the mold is not started to be solidified on the inner wall surface of the mold but is started to be solidified with priority only at the front end of the metal molding or on the rear end of the dummy with respect to the direction of movement of the metal molding, so that the metal molding can be drawn out continuously following the dummy as the dummy is drawn out to the outside of the mold. Accordingly, it is possible to continuously obtain a metal cast product having a smooth outer circumferential surface, having no nest, and having a unidirectional solidified structure elongated in the direction of casting.

However, it has been found that in order to cause the metal molding in the hot mold not to start to be solidified on the inner wall surface of the mold but to start to be solidified only at the front end of the metal molding or the rear end of the dummy with priority, it is necessary to drawn out the dummy from the hot mold at a fixed low rate, while if the drawing rate is made high, there is a possibility that the metal molding cannot adhere on the dummy or the not-yet solidified molten metal may flow as it is out of the outlet of the hot mold.

In U.S. Pat. No. 4,789,022 granted on Dec. 6, 1988, the inventor of this application further proposed a method in which a molten metal is supplied from a nozzle onto a solidification support heated to a value not lower than the solidification temperature of casting metal, and in which the solidification support is moved at a constant speed to thereby draw out a metal molding. The solidification support is formed like an endless belt so that the molten metal is supported on the belt surface, or like a rotary drum so that the top end of the nozzle is caused to come close to an outer circumferential surface of the rotary-drum-like solidification support so as to supply the molten metal onto the outer circumferential surface of the support, whereby the molten metal is prevented from flowing in the direction opposite to the direction of movement of the solidification support.

In such a configuration, the solidification support is heated to a temperature not lower than the solidification temperature of the metal, in the vicinity of the position at which the molten metal is supplied to the solidification support from the nozzle, while the solidification support is also cooled at a cooling portion. Accordingly, the solidification support is heated, cooled, and then heated. That is, the solidification support is subject to repetition of heating and cooling so that it has a defect that it is apt to deteriorate. Specifically, in the case of casting a metal, such as aluminum, copper, ion, or the like, having a high melting point, it has been found that the difference between the heating temperature and the cooling temperature is so large that cracks may occur in the solidification support in a short time or the surface of the solidification support comes off from the body thereof to thereby make the solidification support unusable. Accordingly, the method has been used only for casting a metal, such as tin, zinc, or the like, having a low melting point. Further, the nozzle is arranged so that its top end is close to the solidification support in order to make the molten metal not to flow in the direction opposite to the direction of movement of the solidification support. Since the gap between the top end of the nozzle and the solidification support is so small that the top end of the nozzle sometimes comes into contact with the solidification support with the movement of the solidification support. Accordingly, there is a possibility that the contact causes friction or the like to thereby widen the gap between the top end of the nozzle and the surface of the solidification support to cause so-called breakout so that the molten metal flows out from the gap in the direction opposite to the direction of movement of the solidification support. Further, in the case where the solidification support is made of a material, such as graphite, which may be consumed through oxidization, it is necessary to shield the whole of the solidification support from the air, and a shielding device such as a cover or the like can not but being made large-sized. Accordingly, not only the apparatus becomes expensive but the maintenance and inspection thereof become troublesome.

SUMMARY OF THE INVENTION

It is therefore an object of the present invention to provide a method for horizontal continuous casting of a metal strip cast product in which a metal cast product having an unidirectional solidified structure elongated in the direction of casting can be continuously obtained without causing breakout even if the rate of drawing-out a metal molding from a hot mold is increased.

It is another object of the present invention to provide an apparatus for horizontal continuous casting of a metal strip cast product in which a metal cast product having an unidirectional solidified structure elongated in the direction of casting can be continuously obtained without causing breakout even if the rate of drawing-out a metal molding from a hot mold is increased.

In order to attain the above objects, according to an aspect of the present invention, provided is a method for horizontal continuous casting of a metal strip cast product having a unidirectionally solidified structure elongated in the direction of casting, comprising the steps of supplying a molten casting metal into a hot mold having a shape substantially like a gutter opened at its upper side and being heated to a temperature not lower than the solidification temperature of the casting metal, and drawing out a metal molding formed in the hot mold by using a dummy member while cooling the drawn-out metal molding, wherein the cooling is performed on the metal molding within the hot mold at a position in the front of a solidification starting end portion of the metal molding but in the rear of an outlet of the hot mold with respect to the direction of movement of the metal molding.

According to another aspect of the present invention, provided is an apparatus for horizontal continuous casting of a metal strip cast product having a unidirectionally solidified structure elongated in the direction of casting, comprising: a hot mold having a shape substantially like a gutter opened at its upper side and being heated by a heating means to a temperature not lower than the solidification temperature of a casting metal; a dummy member for drawing out a metal cast's molding made, in the hot mold, of a molten metal of the casting metal supplied into the hot mold in the hot mold; and a cooling means for cooling the metal molding; wherein the cooling means is provided above an upper opening of the hot mold at a position in the front of a solidification starting end portion of the metal molding but in the rear of an outlet of the hot mold with respect to the direction of movement of the metal molding.

According to the present invention, the molten metal is not solidified on the inner wall surface of the hot mold which is kept to a temperature not lower than the solidification temperature of the casting metal but the solidification is started from only the portion where the molten metal comes into contact with the dummy member. Then, as the dummy member is drawn out, the metal molding formed successively from the portion of the molten metal being in contact with the rear end of the dummy member, with respect to the direction of drawingout, is cooled so that the solidified metal strip molding having a desired sectional shape is obtained at the outlet of the hot mold. Further, since the metal molding is cooled so that the solidification is completed within the hot mold, the metal molding can be continuously drawn out without causing breakout of the molten metal even if the metal molding is drawn out at a high drawing rate. The thus obtained strip cast product of a metal or an alloy has no possibility of surface cracks, has no central segregation or no nest, and has a complete unidirectional solidified structure elongated in the direction of casting. Further, only by changing the depth or width of the hot mold, or by changing the level of the molten-metal surface in the molten-metal holding furnace, it is possible to produce a metal strip molding having desired thickness or width.

Further, in the apparatus for realizing the above method for horizontal continuous casting of a metal strip cast product, with an extremely simple configuration in which a hot mold having a shape substantially like a gutter opened at its upper side is provided substantially horizontally on the molten-metal holding furnace, and the cooling means is provided at a position in front of a solidification starting end portion of the metal molding but in the rear of an outlet of the hot mold with respect to the direction of movement of the metal molding, it is possible to draw out the metal molding at a high drawing rate without causing any breakout to thereby produce the metal strip molding having the unidirectional solidified structure elongated in the direction of casting through mass production efficiently.

Other objects and advantages of the present invention will become more apparent in the following description of preferred embodiments.

DETAILED DESCRIPTION OF PREFERRED EMBODIMENTS

Referring to the accompanying drawings, the present invention will be described hereunder with respect to embodiments of the apparatus for realizing the method according to the present invention.

Figure 1:
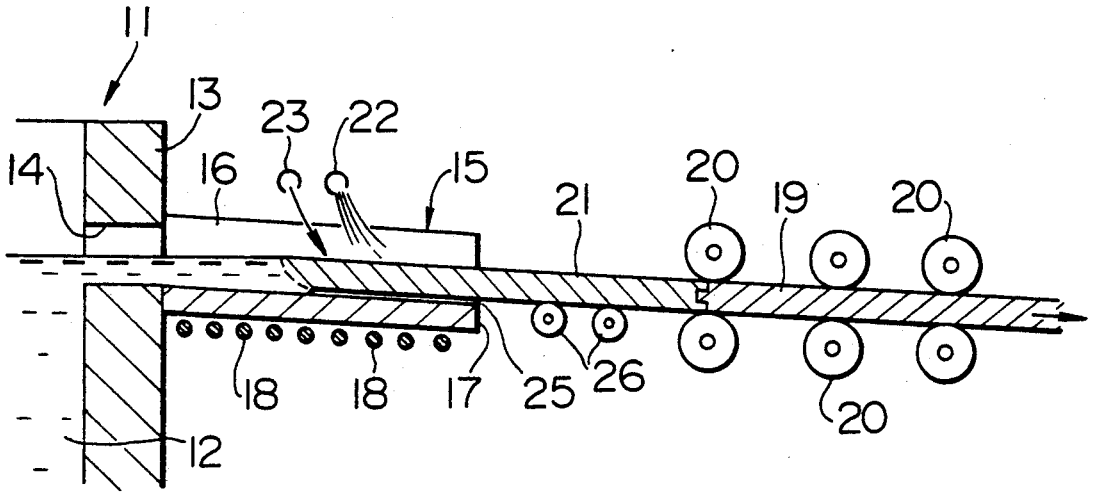
FIG. 1 is a schematic vertical section showing a main portion of an embodiment of the apparatus for realizing the method for horizontal continuous casting of a metal strip casting product according to the present invention.
Figure 2:
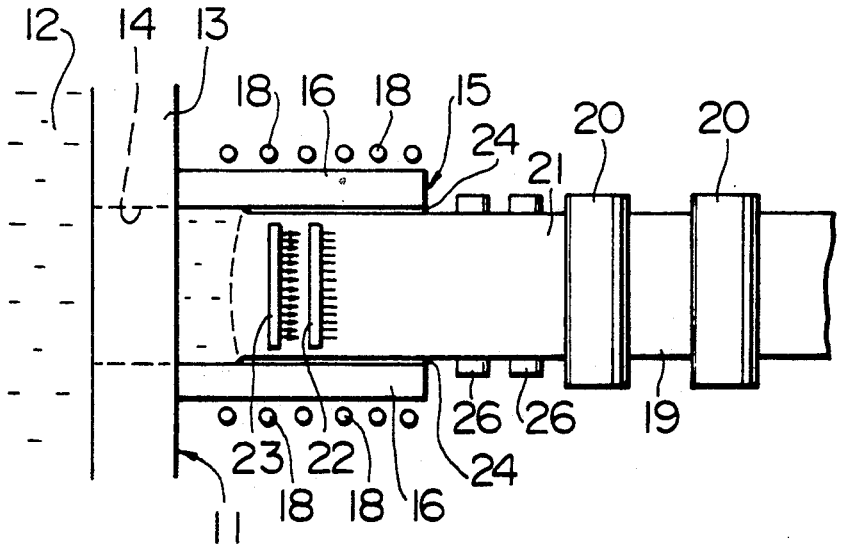
FIG. 2 is a plan view of the same.

In FIGS. 1 and 2, a molten metal 12 to be cast is received in a molten-metal holding furnace 11, the level of the molten metal 12 being kept constant as possible by a general means (not shown). An opening portion 14 is formed in a side wall 13 of the molten-metal holding furnace 11, and a molding hot mold 15 is attached to the opening portion 14 so that the inlet side of the mold 15 communicates with the inside of the molten-metal holding furnace 11. The hot mold 15 is attached to the side wall 13 of the molten-metal holding furnace 11 so as to be substantially horizontal, preferably so as to be slightly inclined down by 2–5 degrees from its inlet side towards its outlet side as shown in the drawing. The hot mold 15 has a shape of substantially like a gutter having a concave section opened at its upper side. A heating element 18 is provided on opposite side walls 16 and a bottom wall 17 of the hot mold 15 so that the inner wall surface of the hot mold 15 which is to be in contact with the molten metal 12 is heated by the heat of the heating element 18 so as to be kept to a temperature not lower than the solidification temperature of a casting metal. Although the heating element 18 is attached on the outer circumferential surfaces of the opposite side walls 16 and the bottom wall 17 in the drawings, the element 18 may be incorporated inside the opposite side walls 16 and the bottom wall 17. The heating element 18 is constituted by an electric resistor heating element whose temperature is changed correspondingly to a supplied electric current, so that the temperature of the inner walls of the hot mold 15 is adjusted by the heating element 18. The hot mold 15 is attached on the side wall 13 of the molten-metal holding furnace 11 so that the bottom wall 17 of the hot mold 15 is positioned under the level of the molten metal 12 so as to obtain a desired strip thickness. A metal molding dummy 19 is arranged so as to be frontward/rearword movably inserted from the outlet side of the hot mold 15 into the hot mold 15 by means of upper and lower drawing pinch rolls 20 arranged in vertical pairs. The pinch rolls 20 are arranged so that the drawing direction by the pinch rolls 20 is slightly downward inclined so as to substantially linearly draw out the metal mold dummy 19 drawn from the hot mold 15 with its outlet side slightly inclined downward.

A cooling spray 22 which is a cooling means for cooling a metal molding 21 drawn out while being in contact with the rear end of the metal mold dummy 19, with respect to the direction of drawing-out, is provided above the opening portion of the hot mold 15. The cooling spray 22 serves to cool the metal molding 21 by jetting cooling water. The cooling spray 22 is arranged so as to jet the cooling water substantially over the entire width of the metal molding 21 and arranged so as to jet the cooling water toward the outlet of the hot mold 15 so that no water splashes on the molten metal 12. An air curtain member 23 is provided between the portion above the solidification starting end of the metal molding 21 and the cooling spray 21 so as to blow a gas such as air or the like onto the upper surface of the metal molding 21 to thereby prevent steam or spattered water generated when the metal molding 21 is cooled by the cooling spray 22 from going to the molten metal 12 side. In place of the cooling water, a cooling gas may be jetted. Further, it is a matter of course that petroleum may be used as a cooling medium in the case of casting a metal, such as sodium, strontium, or lead, having good reaction with water, and a liquid metal such as sodium or potassium may be used as a cooling medium in the case of casting a high melting point metal such as an iron alloy, a nickel alloy, or the like. Further, level-controlling guide rollers 26 are provided between the outlet of the hot mold 15 and the pinch rolls 20 so as to rotatably engage with the respective bottom portions of the metal molding dummy 19 and the metal molding 21 drawn out following the metal molding dummy 19.

The production of metal strip cast products by use of the casting apparatus having such a configuration as described above will be described hereunder. First, the temperature of the inner wall of the hot mold 15 with which the molten metal 12 comes into contact is adjusted to be a value not lower than the solidification temperature of the metal to be cast by controlling an electric current to be supplied to the element 18. It is necessary that this temperature is selected so as to be considerably higher than the solidification temperature of the metal taking the fact that the rear-half portion of the hot mold 15, with respect to the direction of drawing-out, is cooled by the cooling water into consideration. In this state, the metal molding dummy 19 is inserted from the outlet end of the hot mold 15 toward the opening portion 14, while the molten metal 12 is supplied from the molten-metal holding furnace 11 into the hot mold 15. The rear end of the metal molding dummy 19 is made to come into contact with the molten metal 12 flowing into the hot mold 15 through the inlet thereof. Since the upper surface of the metal molding dummy 19 is cooled by the cooling spray 22 when the metal molding dummy 19 is inserted into the hot mold 15, the molten metal 12 is not solidified on the inner wall surface of the hot mold 15 which is kept to be at a temperature not lower than the solidification temperature of the molten metal, but starts to be solidified from the portion which comes into contact with the cooled metal molding dummy 19. Next, the metal molding dummy 19 is drawn out rightward in the drawing by the pinch rolls 20, so that the metal molding 21 which has been formed successively from the portion adhering to the rear end of the metal molding dummy 19 comes into a position just under the cooling spray 22 so as to be cooled thereat by the cooling spray 22. Thus, the solidified metal strip molding 21 having a desired sectional shape is obtained. Since the metal molding 21 is cooled so as to complete the solidification within the hot mold 15 as described above, the metal molding 21 can be continuously drawn out without causing breakout from the molten metal 12 even if the metal molding 21 is drawn out at a high drawing rate. Further, because the hot mold 15 and the drawing direction by means of the pinch rolls 20 are inclined downward as described above, the molten metal 12 can be made to continuously flow into the hot mold 15, it is possible to surely prevent disconnection or the like due to drawing-out from occurring between the molten metal 12 and the metal molding 21.

Further, since the metal molding 21 is slightly contracted through cooling, so that gaps 24 are formed between the opposite side walls 16 of the hot mold 15 and the opposite side surfaces of the metal molding 21 respectively. On the other hand, since the metal molding dummy 19 and the metal molding 21 are slightly raised by the level-controlling guide rollers 26, a gap 25 is formed between the bottom surface of the metal molding 21 and the bottom wall 17 of the heating mold 15. Accordingly, the metal molding 21 is made to slightly float from the bottom wall 17 of the hot mold 15 through the gaps 24 and 25. Accordingly, the metal molding 21 can be drawn out with no friction with the inner walls of the hot mold 15.

The thickness of the metal molding 21 can be selected by adjusting the surface level of the molten metal 12 in the molten-metal holding furnace 11 relative to the level of the bottom wall 17 of the hot mold 15. Further, the width of the metal molding 21 can be selected by adjusting the width between the opposite side walls 16 of the hot mold 15. Accordingly, the metal molding having desired thickness and width can be obtained only by changing the shape of the hot mold 15.

As the hot mold 15, it will do to use a mold of the type made of graphite for casting an alloy having a low solidification temperature, for example, an alloy of aluminum or copper, while it will do to use a mold of the type made of a fireproof material such as alumina, silica, beryllia, magnesia, thoria, zirconia, boronite, silicon carbide, silicone nitride, or the like, for casting steel, cast iron, or an alloy having a high melting point. In selecting the type of the mold, it is necessary to select a material which reacts with the molten metal but is not corroded by the latter. It is desirable that the surface of the molten metal in the hot mold 15 is kept in an inert or reducing atmosphere in order to prevent oxidization thereof.

Further, since the cooled metal molding 21 is continuously drawn out from the outlet of the hot mold 15 by the pinch rolls 20, irregular swinging or vibration of the metal molding 21 in the drawing operation can be prevented, and therefore, distortion or the like of the metal molding 21 due to such swinging or vibration can be prevented. Further, because the metal molding 21 is slightly raised by the level-controlling guide rollers 26, a gap is formed between the bottom surface of the metal molding 21 and the bottom wall 17 of the hot mold 15 so that the metal molding 21 can be surely prevented from rubbing the inner wall of the hot mold 15. In order to more surely prevent the rubbing of the metal molding 21 in the drawing operation, the outlet of the hot mold 15 may be made a little wider than the inlet thereof, that is, the opposite side walls 16 may be previously set to be spread outwardly. With the above configuration of the hot mold, it is possible to cast a metal, which expands when solidified, such as bismuth, silicon, or the like.

Further, when the hot mold 15 is arranged so that its outlet side is made so as to be slightly lower than its inlet side, the cooling water of the cooling spray 22 does not flow onto the molten metal side but flows naturally onto the outlet side.

Figure 3:
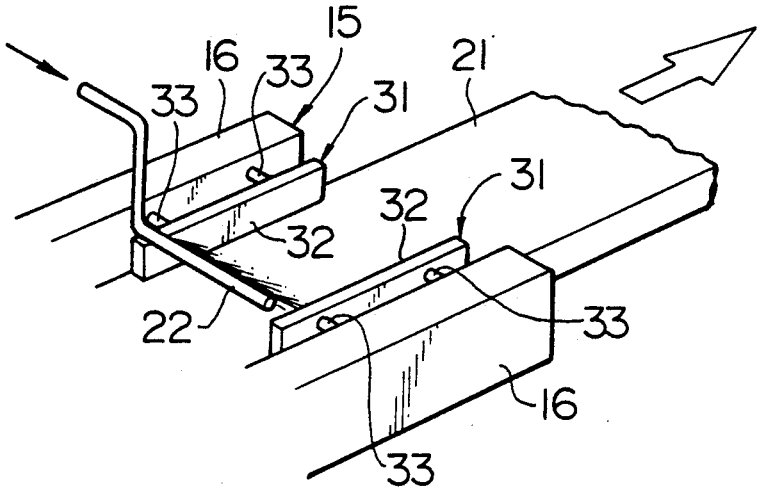
FIG. 3 is a partial perspective view showing another embodiment of the cooling portion in the horizontal continuous casting apparatus.
Figure 4:
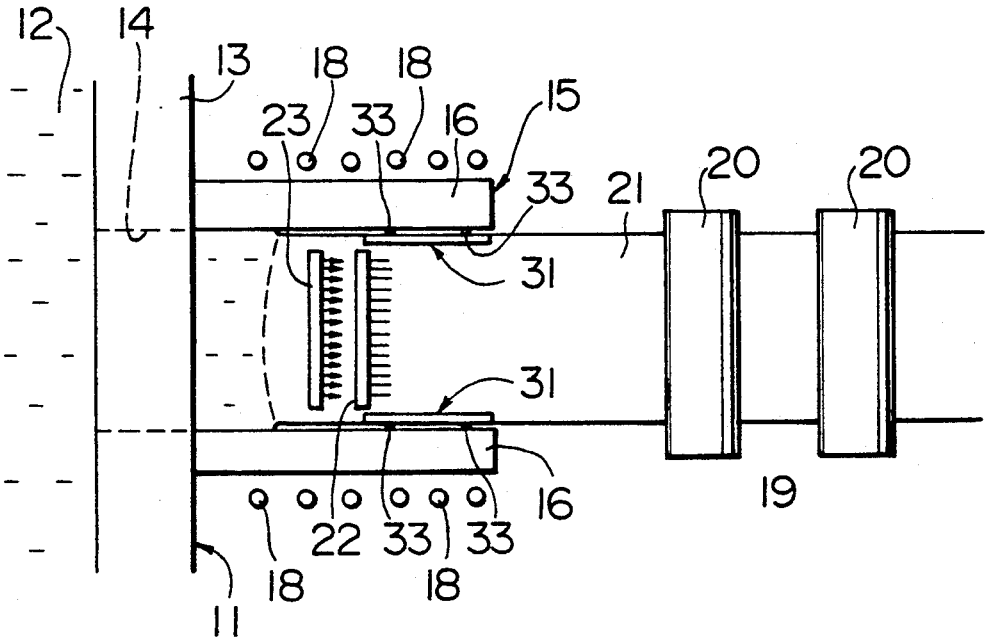
FIG. 4 is a plan view of the same.

FIGS. 3 and 4 show another embodiment of the cooling portion. In this embodiment, restriction members 31 are provided on the inner surfaces of the opposite side walls 16 of the hot mold 15 respectively so that cooling water jetted from the cooling spray 22 does not flow from the gaps 24 between the side surfaces of the metal molding 21 and the side surfaces of the hot mold 15 into the gap 25 between the lower surface of the metal molding 21 and the bottom wall 17 of the hot mold 15 to thereby prevent the hot mold 15 from being cooled. Each of the restriction members 31 is constituted by a restriction plate 32 which is extended along corresponding one of the side walls 16 of the hot mold 15 so that its lower end edge comes into slight contact with the upper end surface of the metal molding 21, and support portions 33 for supporting the restriction plate 32 so as to make the restriction plate 32 positioned slightly inside the corresponding one of the side edges of the metal molding 21. The support portions 33 of each of the restriction members 31 are fixed at their one ends to the corresponding restriction plate 32 at its longitudinally opposite end portions and also fixed at their other ends to the corresponding side wall 16 of the hot mold 15. In the case where it is not desirable that the upper surface of the metal molding 21 is injured by the restriction plates 32, it is preferable that graphite is attached on lower ends of the restriction plates 32.

Figure 5:
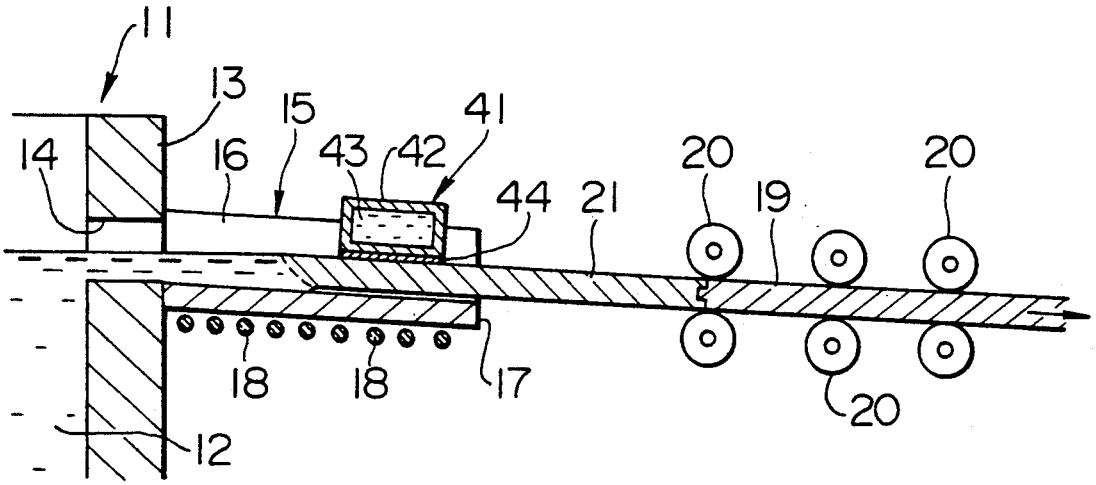
FIG. 5 is a schematic vertical section showing a further embodiment of the cooling portion.

FIG. 5 shows the case in which used is a water jacket as a further embodiment of the cooling means. That is, a cooling means 41 is provided so that its lower surface comes into contact with the upper surface of the metal molding 21. The cooling means 41 is constituted by a metal casing 42 having a hollow inside, and a cooling medium 43, for example, cooling water or a gaseous refrigerant such as a flon gas, which is circulatingly supplied into the casing 42. The casing 42 cooled by this cooling medium 43 is touched to the metal molding 21 to thereby cool the metal molding 21. Because the cooling water is not directly poured unlike in the above embodiment, the process for exhausting the water used for cooling the metal molding 21 becomes unnecessary. A graphite plate 44 is attached on the lower surface of the casing 42 to thereby prevent the upper surface of the metal molding 21 from being injured by the contact with the casing 42. It is a matter of course that the graphite plate 44 is not necessary in the case where the upper surface of the metal molding 21 is not required to be smooth.

Referring to the preferred embodiments, the present invention has been described above. The description has been performed for understanding of the present invention, and the present invention can be variously modified unless the modification departs from the spirit of the accompanying claims.

What is claimed is:

1. A method for horizontal continuous casting of a metal strip cast product having a unidirectionally solidified structure elongated in the direction of casting, comprising the steps of supplying a molten casting metal into a hot mold having a shape substantially like a gutter opened at its upper side and being heated to a temperature not lower than the solidification temperature of said casting metal, and drawing out a metal molding formed in said hot mold by using a dummy member while cooling said drawn-out metal molding, wherein the cooling is performed on said metal molding within said hot mold at a position in front of a solidification starting end portion of said metal molding but in the rear of an outlet of said hot mold with respect to the direction of movement of said metal molding.

2. A method for horizontal continuous casting of a metal strip cast product according to claim 1, in which said metal molding is drawn out in a manner so that a slight gap is formed between a bottom wall of said hot mold and a bottom portion of said metal molding within said hot mold in the vicinity of said outlet of said hot mold.

3. A method for horizontal continuous casting of a metal strip cast product according to claim 1, in which said cooling is performed with a liquid.

4. A method for horizontal continuous casting of a metal strip cast product according to claim 1, in which said cooling is performed with a cooling gas.

5. A method for horizontal continuous casting of a metal strip cast product according to claim 1, in which said cooling is performed with water.

6. A method for horizontal continuous casting of a metal strip cast product according to claim 1, in which said cooling is performed with petroleum.

7. A method for horizontal continuous casting of a metal strip cast product according to claim 1, in which said cooling is performed with a liquid metal.

8. A method for horizontal continuous casting of a metal strip cast product according to claim 1, a medium for said cooling is prevented by a shielding means from flowing onto said solidification starting end portion of said metal molding.

9. A method for horizontal continuous casting of a metal strip cast product according to claim 1, in which said hot mold is arranged so that its outlet is positioned so as to be slightly lower than its inlet to thereby prevent a medium for the cooling from flowing onto said solidification starting end portion.

10. An apparatus for horizontal continuous casting of a metal strip cast product having a unidirectionally solidified structure elongated in the direction of casting, said apparatus comprising: a hot mold having a shape substantially like a gutter opened at its upper side and being heated by a heating means to a temperature not lower than the solidification temperature of a casting metal; a dummy member for drawing out a metal molding made, in said hot mold, of a molten metal of said casting metal supplied into said hot mold in said hot mold; and a cooling means for cooling said metal molding;

wherein said cooling means is provided above an upper opening of said hot mold at a position in front of a solidification starting end portion of said metal molding but in the rear of an outlet of said hot mold with respect to the direction of movement of said metal molding.

11. An apparatus for horizontal continuous casting of a metal strip cast product according to claim 10, said cooling means is constituted by nozzle means arranged in the direction of width of said metal molding and a liquid jetted from said nozzle means.

12. An apparatus for horizontal continuous casting of a metal strip cast product according to claim 10, said cooling means is constituted by nozzle means arranged in the direction of width of said metal molding and a cooling gas jetted from said nozzle means.

13. An apparatus for horizontal continuous casting of a metal strip cast product according to claim 10, said cooling means is constituted by nozzle means arranged in the direction of width of said metal molding and a water jetted from said nozzle means.

14. An apparatus for horizontal continuous casting of a metal strip cast product according to claim 10, said cooling means is constituted by nozzle means arranged in the direction of width of said metal molding and petroleum jetted from said nozzle means.

15. An apparatus for horizontal continuous casting of a metal strip cast product according to claim 10, said cooling means is constituted by nozzle means arranged in the direction of width of said metal molding and a liquid metal jetted from said nozzle means.

16. An apparatus for horizontal continuous casting of a metal strip cast product according to claim 10, in which said cooling means is constituted by a hollow casing provided so as to be in contact with an upper surface of said metal molding, and selected one of water and a refrigerant supplied into said casing.

17. An apparatus for horizontal continuous casting of a metal strip cast product according to claim 10, in which a shielding means for preventing a medium in said cooling means from flowing onto said solidification starting end portion is provided between said solidification starting end portion and said cooling means.

18. An apparatus for horizontal continuous casting of a metal strip cast product according to claim 10, in which said cooling means is constituted by nozzle means arranged in the direction of width of said metal molding and water jetted from said nozzle means, and in which restriction members are provided on opposite side walls of said hot mold respectively and positioned so that respective lower end edges of said restriction members are slightly in contact with an upper surface of said metal molding, and so that said restriction members are extended from the lower portion of said cooling means toward said outlet of said hot mold to thereby prevent said water from flowing from said side surfaces of said hot mold onto a bottom surface thereof.

19. An apparatus for horizontal continuous casting of a metal strip cast product according to claim 10, in which guide rollers are provided on the outlet side of said hot mold so as to rotatably engage with respective lower surfaces of said dummy member and said metal molding to thereby control levels of said respective lower surfaces of said dummy member and said metal molding so as to form a slight gap between a bottom wall of said hot mold and a bottom portion of said casting metal in said hot mold in the vicinity of the outlet thereof.

20. An apparatus for horizontal continuous casting of a metal strip cast product according to claim 10, in which the width of said hot mold is made wider at its outlet side than at its inlet side.

* * * * *